US006571522B1

(12) United States Patent
Perini

(10) Patent No.: US 6,571,522 B1
(45) Date of Patent: Jun. 3, 2003

(54) COVERING SYSTEM FOR BUILDINGS

(76) Inventor: Fabio Perini, Via San Francesco 1, 55049 Viareggio, Lucca (IT)

( * ) Notice: Subject to any disclaimer, the term of this patent is extended or adjusted under 35 U.S.C. 154(b) by 0 days.

(21) Appl. No.: 09/555,365

(22) PCT Filed: Dec. 1, 1998

(86) PCT No.: PCT/IT98/00346

§ 371 (c)(1),
(2), (4) Date: May 30, 2000

(87) PCT Pub. No.: WO99/30088

PCT Pub. Date: Jun. 17, 1999

(30) Foreign Application Priority Data

Dec. 5, 1997 (IT) ..... FI97A0267

(51) Int. Cl.[7] ..... E04B 1/70

(52) U.S. Cl. ..... 52/302.3; 52/302.1; 52/18; 52/199; 52/473; 454/250; 454/260; 454/264; 454/265; 454/268; 454/277

(58) Field of Search ..... 52/302.1, 302.3, 52/302.4, 302.7, 200, 199, 198, 533, 18, 258, 473, 474, 90.1, 90.2, 91.1, 91.3; 454/250, 260, 264, 265, 268, 275, 277

(56) References Cited

U.S. PATENT DOCUMENTS

| | | | | | |
|---|---|---|---|---|---|
| 3,788,014 A | * | 1/1974 | Semisch | ..... | 52/18 |
| 4,890,900 A | * | 1/1990 | Walsh | ..... | 350/263 |
| 5,653,067 A | * | 8/1997 | Lago | ..... | 52/90.1 |
| 5,655,335 A | * | 8/1997 | Vermeer | ..... | 52/66 |

* cited by examiner

*Primary Examiner*—Carl D. Friedman
*Assistant Examiner*—Yvonne M. Horton
(74) *Attorney, Agent, or Firm*—Breiner & Breiner, L.L.C.

(57) ABSTRACT

The covering system includes at least one panel capable of being placed in an inclined position with respect to a horizontal. The panel incudes an inner chamber, a plurality of suction apertures through which the inner chamber communicates with a void inside of a building, and a discharge aperture disposed at a level higher than the suction apertures when the panel is installed.

3 Claims, 6 Drawing Sheets

COVERING SYSTEM FOR BUILDINGS

TECHNICAL FIELD

The present invention relates to a system for making roofs or coverings for buildings, particularly (but not exclusively) for buildings for industrial use, such as sheds and the like.

BACKGROUND ART

Industrial sheds are frequently covered with coverings known as the "shed" type, consisting of a plurality of pre-stressed concrete beams between which are disposed flat or curved covering panels, one edge of each of which rests on one of the beams, while the other rests on struts of a glazed unit which provides illumination for the premises. In some cases, the glazed units are provided with apertures to provide ventilation for the premises.

In hot climates, the problem arises of ventilating premises which are intensively heated by the sun which irradiates the covering. The panels and the beams forming shed coverings are raised to high temperatures as a result of the irradiation, and this heat is transmitted into the interior of the premises. The glazed unit apertures may in some cases cause air at a higher temperature than the internal temperature to enter the building, thus preventing the outflow of the hot air from the interior and actually causing further heating. This occurs, for example, in the case of wind blowing toward the glazed units: it is possible for air currents to be generated and to flow over the external surface of the covering, with a consequent heating of the air which, when heated in this way, penetrates to the interior of the premises through the apertures of the shed covering.

Covering panels provided with layers of insulating material do not enable sufficient thermal insulation to be obtained, especially in torrid and tropical climates, simply because of the impossibility of extracting the hot air from the interior of the premises in an efficient way.

OBJECTS OF THE INVENTION

The object of the present invention is to provide a covering system which avoids the disadvantages of conventional coverings.

More particularly, a first object of the present invention is to provide a covering system which provides efficient ventilation of the premises beneath it, by preventing the ingress of hot external air and permitting the outflow of hot air from the interior.

The object of one particular possible embodiment of the invention is the provision of a covering system which provides a powerful ventilation of the premises beneath it in periods of high ambient temperature, and prevents the dissipation of heat in the colder periods.

SUMMARY OF THE INVENTION

These and additional objects and advantages, which the following text will make evident to those skilled in the art, are achieved with a system comprising at least one panel capable of being placed on said covering in an inclined position with respect to the horizontal, this panel having an inner chamber, a plurality of suction apertures through which the inner chamber communicates with a void inside the building, and a discharge aperture disposed in the vicinity of the area of the panel which is at a higher level when the panel is installed.

When installed, the panel is disposed with its suction apertures toward the interior of the building and with its discharge aperture disposed toward the exterior. In this way a path is created for an air current which develops through the suction apertures, the inner chamber of the panel and the discharge aperture. In this path, a suction effect is generated by the heat, causing hot air to be extracted from the layers closest to the covering, with consequent expulsion of the hot air to the exterior and suction of lower-temperature air through windows, doors or apertures made in the most suitable points of the building, preferably in the lower area. The suction effect is produced simply by the heating of the internally hollow panel which, with the suction and discharge apertures, forms a kind of chimney. The presence of an inner chamber in the panel also reduces the temperature of the surface of the panel facing the interior of the covered environment, reducing the effect of heating by radiation. The surface area of the air chamber may be identical to that of the panel, or may correspond to only a part of it.

Theoretically, the discharge aperture may be made in any shape, the only significant characteristic being its location in an area at a sufficiently high level with respect to the suction apertures. Preferably, however, the discharge aperture is made in the shape of a slot which extends in the direction of the width of the panel, in the vicinity of the upper edge of the panel and preferably over the whole width, in such a way as to generate an outgoing air current which is uniform over the whole transverse extension of the panel.

The discharge aperture may be delimited by the two parallel edges of two sheets delimiting the lower and upper surfaces of the panel. In this case, the lower sheet is larger than the upper sheet, thus leaving an aperture on the upper surface of the panel, from which the hot air can flow out. According to a particularly advantageous embodiment, however, the slot which forms the discharge aperture is delimited by sections which are inclined with respect to the panel. The inclination of the sections is such as to prevent any wind which may strike the sides of the building from impeding the outflow of hot air from the interior through the slot. The presence of the sections also increases the suction effect due to the temperature, in other words what is known as the "chimney" effect.

To prevent the penetration of rain water through the discharge aperture and the suction apertures into the building, it is possible for the suction apertures to be absent in the area corresponding to the discharge aperture. It is also possible to provide suitable means which prevent the penetration of the water, for example projections or protective edges above or around the suction apertures.

The panel may theoretically be made from any material. According to a preferred embodiment, it is made from sheet metal, for example aluminum sheet (to avoid problems of corrosion and to obtain a particularly light structure). In this case, the panel may be formed from an upper sheet and a lower sheet connected together by connecting means, for example lattice beams, connecting brackets, internal diaphragms, grids, internal or external bars, or other equivalent systems. The two sheets and said connecting systems can thus form a panel which can be self-supporting and is very light.

According to a particularly advantageous embodiment, at least the upper panel has a troughed cross section with channels and ribs extending longitudinally with respect to the said panel. The lower panel may be flat or may also have a corresponding fretted cross section. Depending on the shape of the lower panel, various systems may be provided to collect and discharge any rain water which may penetrate through the discharge aperture or slot. For example, if the lower panel is shaped with a troughed cross section, the longitudinal channels present in it may act as water drainage channels and in this case one or more water discharge slots are provided on the back. Conversely, particularly if the lower sheet is flat, a front transverse channel, extending parallel to the discharge slot or aperture, may be provided for the collection of the rain water.

Alternatively, an external protective section may be provided above the discharge slot.

When it is wished to have a covering panel which is also usable in climates in which the ambient temperature may fall to levels such that ventilation and the extraction of hot air from the interior of the building are no longer necessary, the covering panel may advantageously be provided with means of intercepting or closing the suction apertures or the discharge aperture. These closing means may be made in the form of one or more sliding diaphragms having apertures corresponding to the suction apertures and capable of assuming, alternatively, a position in which the apertures of the diaphragm coincide with the suction apertures or one in which they are out of alignment with them. In the first case, the air can flow through the panel, while in the second case the flow of extracted air cannot be established and consequently the heat is not extracted from the environments beneath. Alternatively, a shutter may be provided to close the discharge aperture, or a closing partition may be provided inside the chamber to intercept the path of the air between the discharge aperture and the suction apertures.

The covering system according to the invention can also be advantageously applied to buildings for non-industrial use and also, in particular, to buildings with multiple floors or levels. In this case, at least one of said panels which is in communication with the void beneath it (the loft, for example) is disposed on the covering of said building.

The present invention differs from the conventional ventilation systems of coverings for non-industrial buildings, in which gaps are provided between the roof and an underlying insulating layer: in these conventional solutions the only ventilation is by means of air sucked from the exterior, which generates a current flowing over the insulation under the roof tiles. However, there is no extraction of hot air from the interior of the building.

Further advantageous embodiments of the invention are described below and are indicated in the attached claims.

BRIEF DESCRIPTION OF THE DRAWINGS

The invention will be more clearly understood from the description and the attached drawing, which shows a non-restrictive practical example of the invention. In the drawing.

DETAILED DESCRIPTION OF THE PREFERRED EMBODIMENTS

Figure 1:
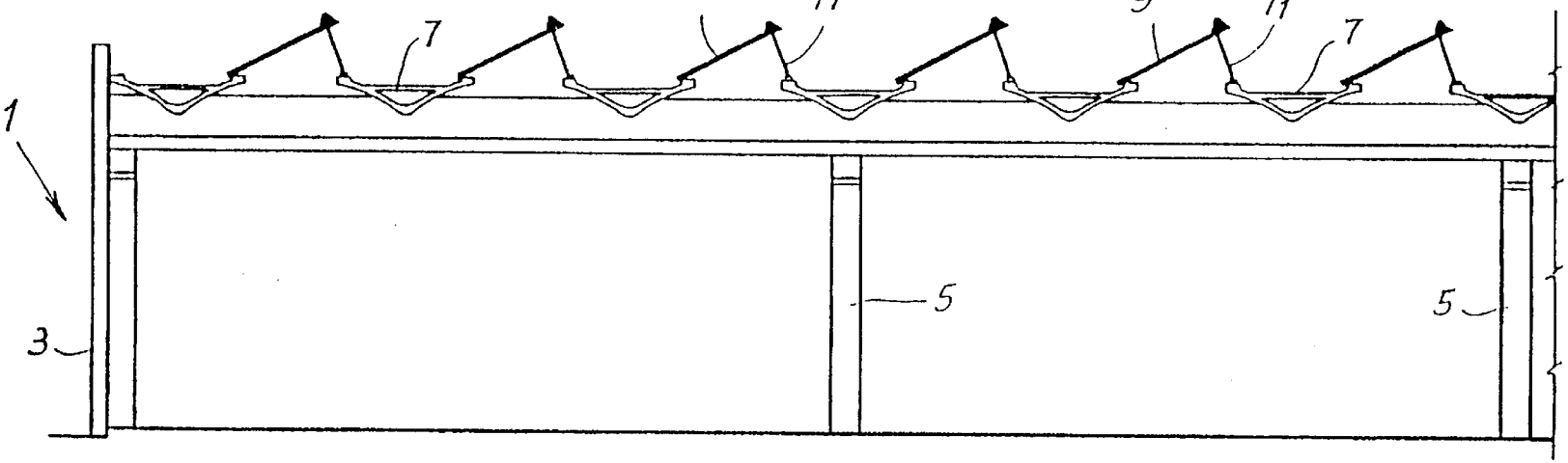
FIG. 1 shows a section through an industrial shed with a shed-type covering.

FIG. 1 shows an example of the application of the covering system according to the present invention in the form of a "shed" type covering of an industrial shed. The shed, indicated in a general way by the number 1, has external peripheral walls 3, pillars 5 and a covering formed by a plurality of beams 7 (commonly called "slabs"), made for example from prestressed concrete, which are spaced apart from each other. Covering panels 9 and glazed units 11 are supported on the slabs 7. Both the panels 9 and the glazed units 11 are inclined with respect to the horizontal.

Figure 3:
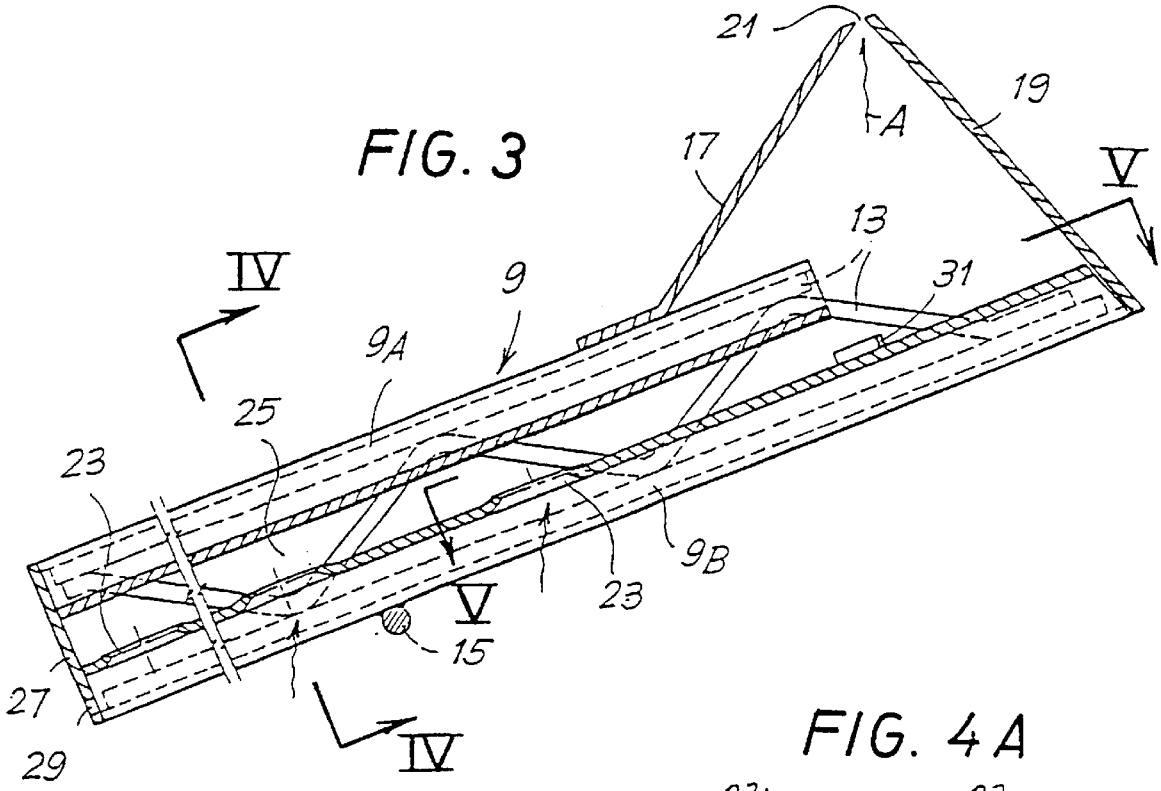
FIG. 3 shows an enlarged longitudinal section of a covering panel according to the invention, in a principal embodiment.
Figure 4A:
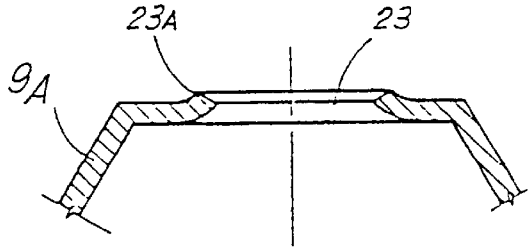
FIG. 4A shows an enlargement of the area $IV_A$ of FIG. 4.
Figure 4:
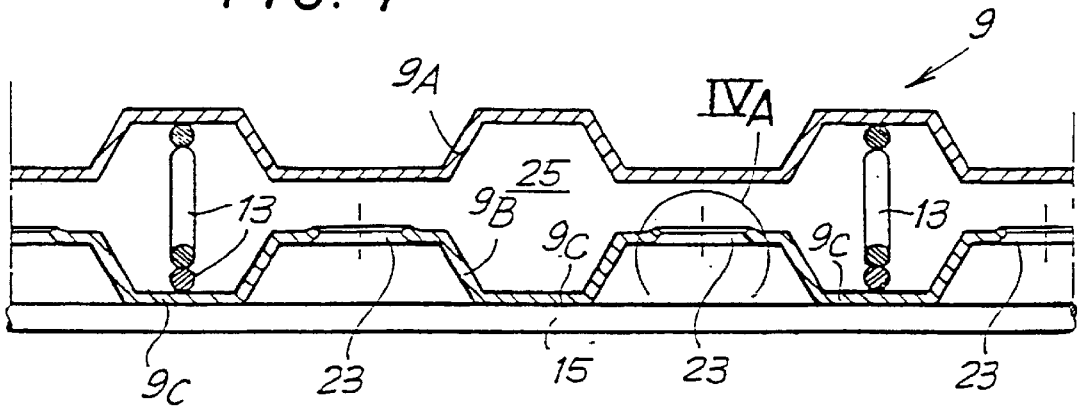
FIG. 4 shows a transverse section through the panel shown in FIG. 3, taken on the plane marked IV—IV in FIGS. 2 and 3.

Each panel 9 consists of two sheets made from aluminum or other suitable material, which can be seen, in particular, in the enlarged sections in FIGS. 3 and 4, and are indicated by the numbers 9A and 9B. Both sheets 9A and 9B have troughed cross sections to impart sufficient mechanical strength to the panel and also for the purposes which will be described below. The two sheets are joined together by suitable connecting and stiffening means which, in the illustrated example, consist of lattice structures 13 extending in the longitudinal direction of the panels, in other words in the direction of the channels generated by the troughed structure of the two sheets 9A, 9B. The two sheets 9A, 9B may be connected together by means of sheet metal diaphragms, connecting brackets or other suitable means, instead of by means of lattices 13, depending on, among other things, the transverse and longitudinal dimensions of the panel 9, the load which it has to withstand, the thickness of the sheets and the depth of the channels of the troughed profile.

Further transverse stiffening may be obtained, for example, by means of bars 15 applied internally or (preferably) externally to the panel 9, as shown in FIGS. 3 and 4. Different systems of transverse stiffening, for example lattice beams similar to the beams 13, suitably perforated dividing partitions, or others, may also be used.

Two inclined sections 17, 19 are applied along the transverse edge of the panel 9 which, when in use, is located in the highest area. The section 17 is integral with the upper sheet 9A, while the section 19 is integral with the lower sheet 9B. The two sections 17, 19 converge toward a vertex line, but without touching each other, in such a way as to leave a slot 21 which extends preferably over the whole width of the panel 9 and which is located at a higher level than the sheets 9A, 9B.

The lower sheet 9B has, along the ribs of the troughed profile which are located closest to the upper sheet 9A, a plurality of apertures 23 through which the inner volume of the shed communicates with the inner chamber 25 of the panel 9, formed by the two sheets 9A, 9B. The apertures 23 are made, in the illustrated example, in the form of large holes punched in the sheet 9B. As Will be clearly apparent from the following text, the shape of the apertures 23 is not restrictive, and it is possible to use different shapes, for example rectangular or slotted, elongated in the direction of the fretted profile of the sheet 9B, or other suitable shapes.

As is clearly apparent from the enlargement in FIG. 4A, each of the apertures 23 has an edge 23A slightly raised toward the interior of the chamber 25, for the purposes which will be explained subsequently.

Figure 2:
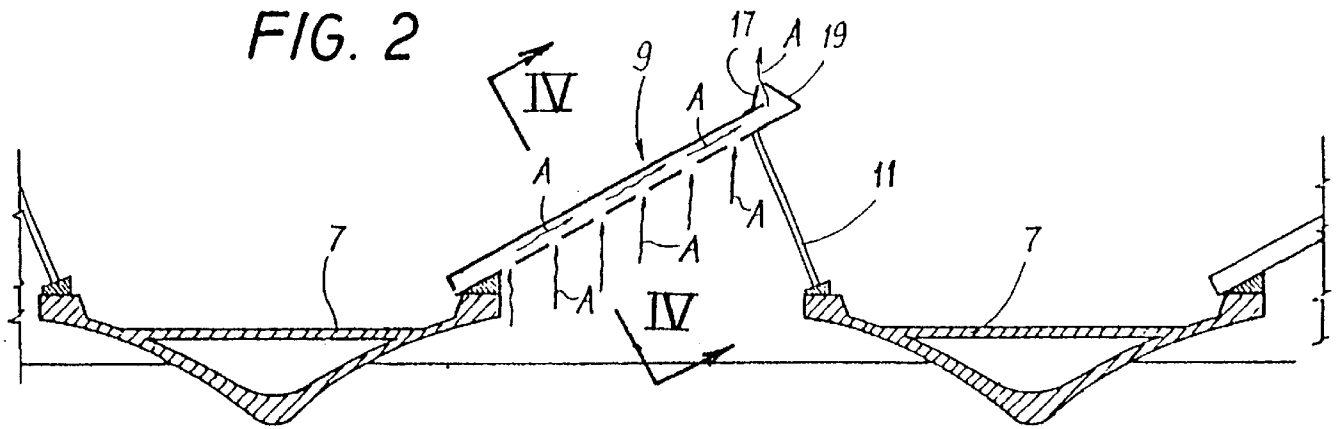
FIG. 2 shows an enlarged section of a portion of the covering.

The panels 9 formed in this way constitute a system for the suction and expulsion of the hot air from the interior of the shed 1. This is because the hottest layers of air inside the shed 1 accumulate in the highest area, in other words under the panels 9. These are additionally heated by the external solar radiation. Consequently, a rising air current is established by the "chimney effect" inside each panel 9, is sucked through the apertures 23 from the interior of the shed 1 and is expelled from the slot 21 which is located at a higher level than the apertures 23. FIG. 2 clearly shows the flow of air which is generated, represented by the arrows A.

The inclination of the sections 17, 19 is such that, in case of a wind in a direction orthogonal to the direction in which the slot 21 extends, it does not impede the outflow of air from the slot, since the external air carried by the wind is diverted upwards by the sections 17 and 19 and tends to promote the extraction of air from the interior of the chamber 25 formed between the two sheets 9A, 9B. The sections 17, 19 also have the function of increasing the suction effect due to the temperature, in that they form a kind of suction "chimney", whose outlet is formed by the discharge slot 21 which is thus located at a higher level than the sheets 9A, 9B forming the panel 9. However, it should be understood that the sections 17, 19 may also be omitted. In this case, the discharge aperture is delimited by the edges of the two panels 9A, 9B which are out of alignment, the lower panel 9B having a greater length than the panel 9A.

The hot air sucked in and expelled by the panels 9 is replaced by air at a lower temperature which is sucked in from the access apertures of the shed and/or from windows specially made in the lower area.

The glazed units 11 may advantageously be fixed and without opening systems, since the ventilation obtained through the apertures 23 into the panels 9 is sufficient. However, the possibility of also having openable glazed units 11 for particular requirements is not excluded.

In case of rain, the water penetrating through the slot 21 into the chamber 25 is easily disposed of along the channels 9C (see FIG. 4) formed by the troughed profile of the sheet 9B. In order to discharge the water from the interior of the panel 9, the panel is closed at the rear by a back sheet 27 (see FIG. 3) which leaves a slot 29 next to each of the channels 9C of the lower sheet 9B. The slots 29 are at least sufficiently large for discharging the water, whereas they offer a much higher aerodynamic resistance than the apertures 23, so that the quantity of air sucked through the slots 29 is zero or minimal and negligible by comparison with that sucked through the apertures 23.

The raised edges 23A of the apertures 23 act in such a way that rain water which falls from the slot 21 onto the ribs in which the apertures 23 are made cannot enter the shed through these apertures but is diverted toward the channels 9C and is then discharged at the back through the slots 29.

Figure 5:
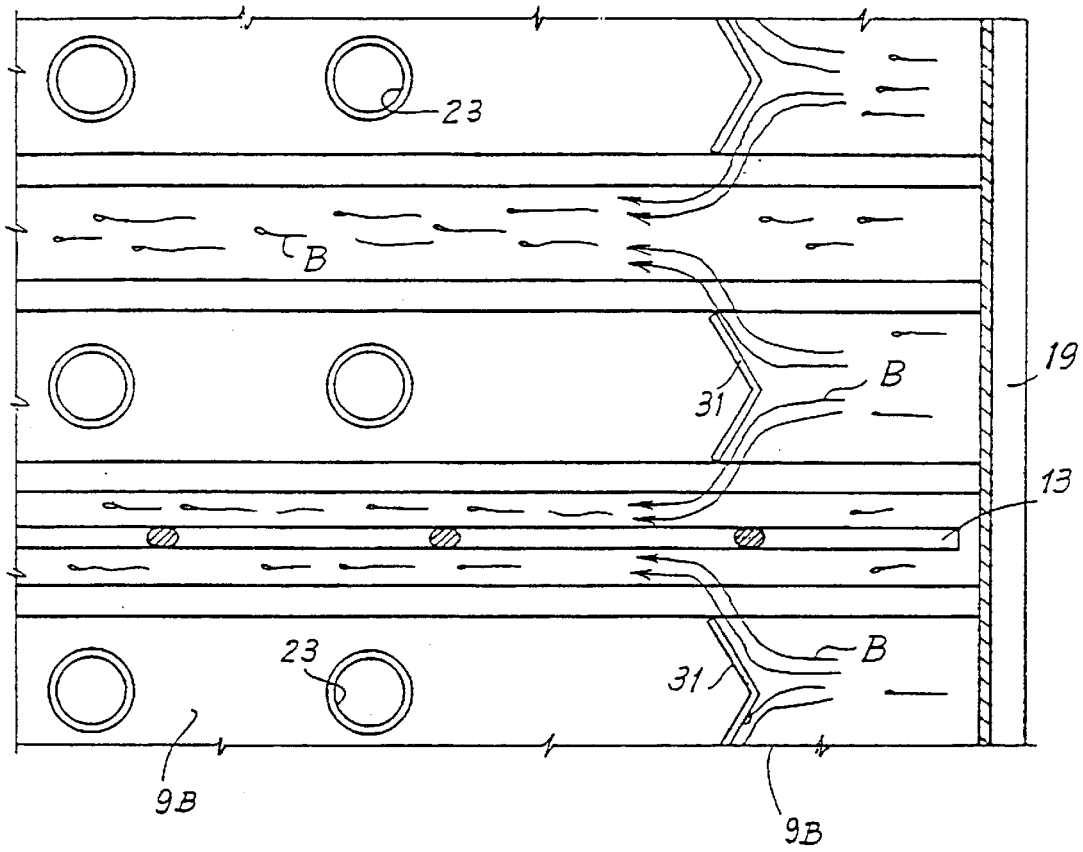
FIG. 5 shows a section taken through V—V in FIG. 3.

FIG. 5 shows a view taken through V—V in FIG. 3, in other words a plan view of the upper area of the sheet 9B. In this view, V-shaped projections 31 are added to form a further barrier to the water which falls onto the ribs of the sheet 9B and to divert the rain water toward the bottom of the channels 9C (arrows B).

Panels made in this way may be used whenever a shed or other equivalent building is to be erected in regions having a hot climate. However, with a further modification the system is also suitable for the construction of coverings in those climatic regions which are subject to large temperature variations in the course of the year, and in which it is convenient to have powerful ventilation and an efficient system of disposal of hot air in the summer months, while the outflow of hot air has to be reduced or eliminated during the winter months. For this purpose, a system of interception of the apertures 23, which is remotely controllable manually or with the aid of suitable actuators, may advantageously be provided.

Figure 6:
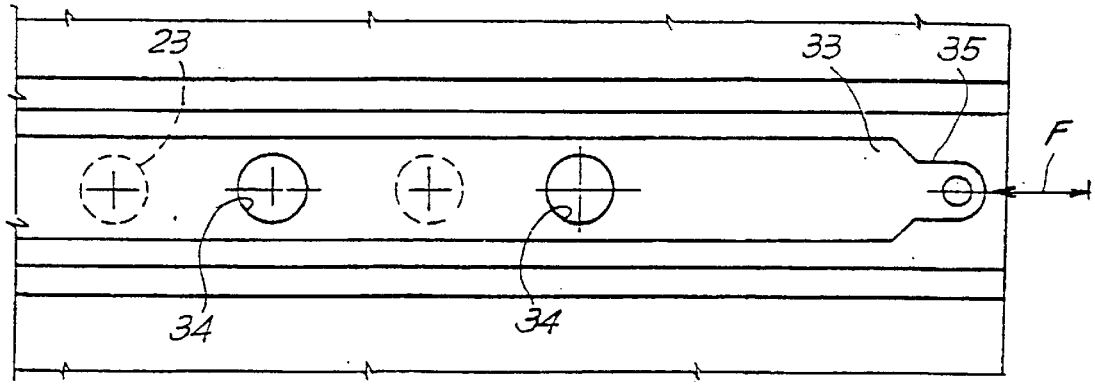
FIG. 6 shows a section, similar to that shown in FIG. 5, of a panel with a system for intercepting the ventilation apertures.

FIG. 6 shows purely by way of example a system of selective closing or interception of the apertures 23. Said figure shows a plan view of a portion of the lower sheet 9B of the panel 9 restricted to a single line of apertures 23. The system consists of a sliding diaphragm 33 provided with a plurality of apertures 34 having the same shapes, dimensions and spacing as those of the apertures 23 in the sheet 9B. The diaphragm is disposed along the rib of the sheet 9B in which the apertures 23 are formed, and is movable as shown by the double arrow F, in such a way that in a first position, shown in FIG. 6, the apertures 34 are out of alignment with the apertures 23, in such a way that the diaphragm 33 closes the apertures 23 and prevents the passage of the air. When the diaphragm 33 is moved as shown by the arrow F through a distance equal to half of the spacing between the apertures 23, the apertures 34 of the diaphragm 33 are brought to the positions of the apertures 23 of the sheet 9B, permitting the air to pass from the interior of the shed toward the exterior through the chamber 25 and the slot 21.

The number 35 indicates an appendage to which an operating rod may be connected. By using a cross-piece to which a number of diaphragms are joined for a plurality of lines of apertures 23, it is possible to use a single operating rod for a comparatively large area of the covering.

The diaphragm 33 may be suitably shaped if the edges of the apertures 23 are raised as shown at 23A.

Figure 7:
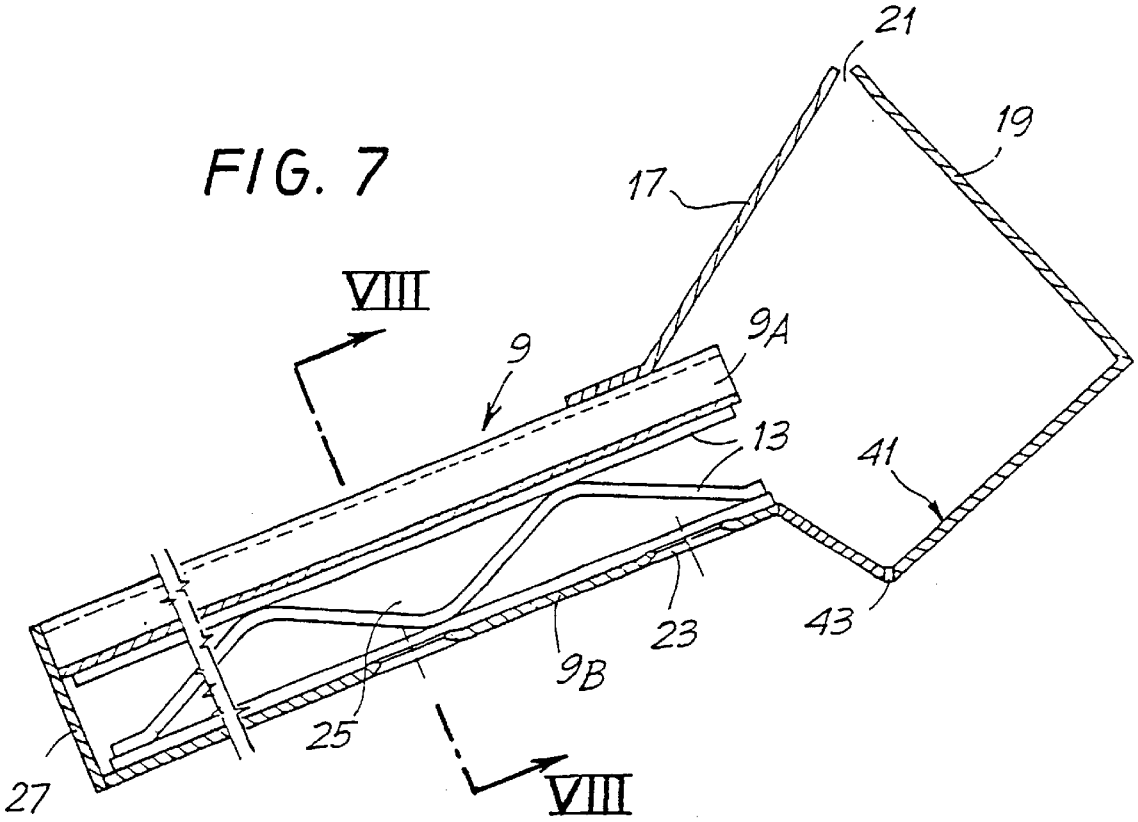
FIG. 7 shows a longitudinal section of a panel according to a further embodiment of the invention.
Figure 8:
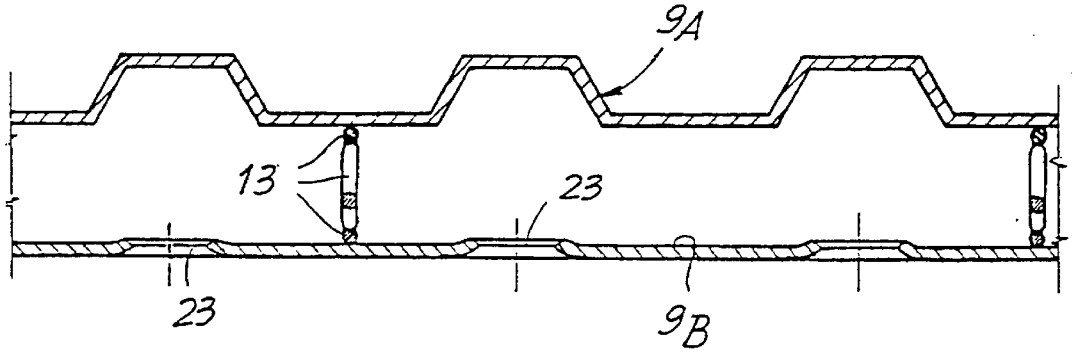
FIG. 8 shows a transverse section, taken through VIII—VIII, of the panel shown in FIG. 7.

FIGS. 7 and 8 show a longitudinal section, similar to the section shown in FIG. 3, through a variant embodiment of the panel 9. Identical numbers indicate parts identical or corresponding to those of the embodiment shown in FIGS. 3 and 4. In this case the lower sheet, again indicated by 9B, is flat instead of having a fretted profile, and is fixed to the upper sheet 9A (which is fretted) by lattice beams 13. The number 23 again indicates apertures in the lower flat sheet 9B. At the rear end, the panel is closed by a back sheet 27 which, unlike the sheet 27 in FIG. 3, does not leave slots for communication with the outside. The sheet 9B is bent in a V shape at the front end to form a channel 41 which extends transversely across the panel 9, in line with the slot 21 for the expulsion of the hot air. The channel 41 is integral with the section 19 which, together with the section 17 integral with the upper sheet 9A, forms the slot 21.

In this configuration, the rain water which may penetrate through the slot 21 is collected in the drainage channel 41 which may be provided at its ends, or (as in the illustrated example) along its bottom, with holes 43 for the discharge of the rain water. As in the case of the slots 29, the holes 43 are also of small size and have a high aerodynamic resistance to reduce the quantity of air sucked through them. In order to further reduce the air sucked through the holes 43, it is possible to arrange for only two of these (or even a single one) to be disposed at a suitable point of the channel 41.

Figure 9:
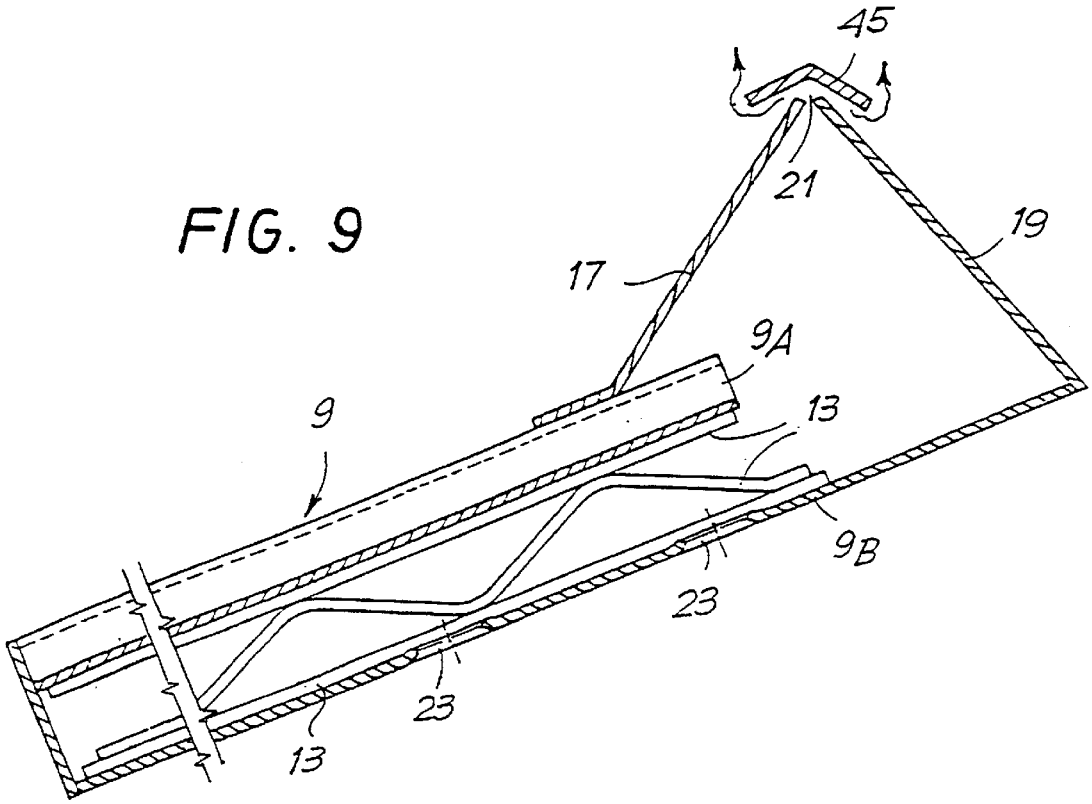
FIG. 9 shows a longitudinal section through a panel according to a third embodiment.

FIG. 9 shows an embodiment in which the slot 21 is covered by an inverted V profile indicated by 45, which prevents the ingress of rain water, while maintaining the possibility of outflow of the hot air sucked from the interior. In this case the holes for discharging the rain water from the inside of the chamber 25 are unnecessary.

Figure 10:
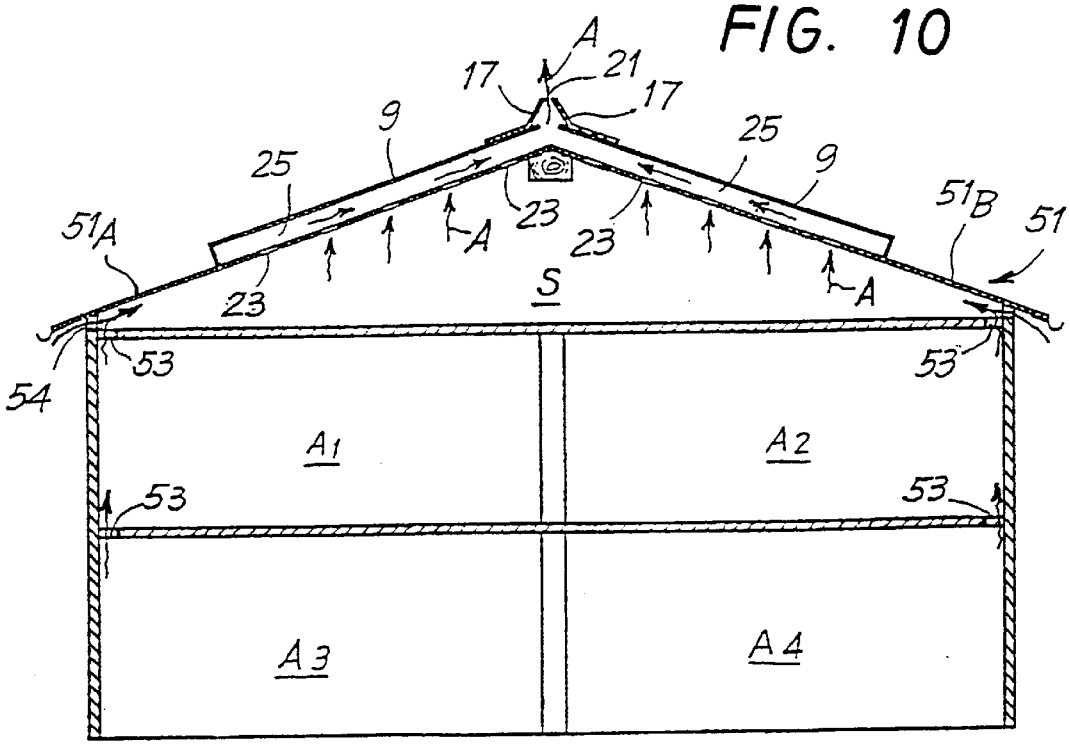
FIG. 10 shows an application of the invention to a non-industrial building.

FIG. 10 shows a form of application of the present invention to a dwelling for non-industrial use, having a roof 51 with two pitches 51A, 51B. In this case, two covering panels 9, fitted to the two pitches 51A, 51B of the roof and brought close to each other at the ridge, are provided, in such a way that the two sections 17 of the two panels 9 brought close to each other form a slot 21. The panels 9 form chambers 25 with holes 23 for communication with the environment beneath them, for example a loft S. The length of each panel 9 is less than that of the slope of the roof, since the hot air accumulates in the area of the ridge and it is therefore sufficient for the apertures 23 to be provided in the vicinity of this area.

In the illustrated example, slots 53 through which the loft S communicates with the environments A1, A2 beneath it are provided along the floor of the loft S. These environments may, in turn, communicate through corresponding slots 53 with the voids A3, A4 beneath them. The hotter air of the lower voids rises through the slots 53 toward the upper voids and up to the loft S from which it is extracted by means of the suction provided by the panels 9. In this case also, it is possible to provide systems (of the type described above or equivalent) to prevent the penetration of rain water and means of closing the suction apertures 23 in the winter months. The apertures 53 may be omitted and apertures 54 which permit the ingress of air from the outside may be used in their place. Conversely, the apertures 53 and 54 may also be used in combination with each other.

Figure 11:
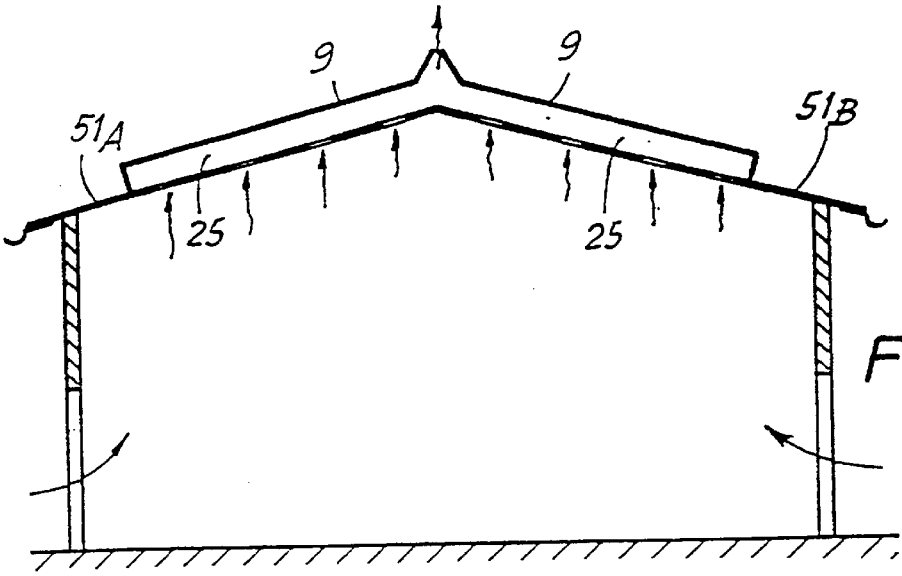
FIGS. 11–13 show schematically the use of the covering system according to the invention in buildings having different types of roof.

FIG. 11 shows an application of the invention to a single-story building with a roof having two pitches, again indicated by 51A and 51B. The number 9 indicates the two covering panels with air chambers 25. The suction through the panels 9 draws air from below, for example through the access apertures of the building, as shown in the figure.

Figure 12:
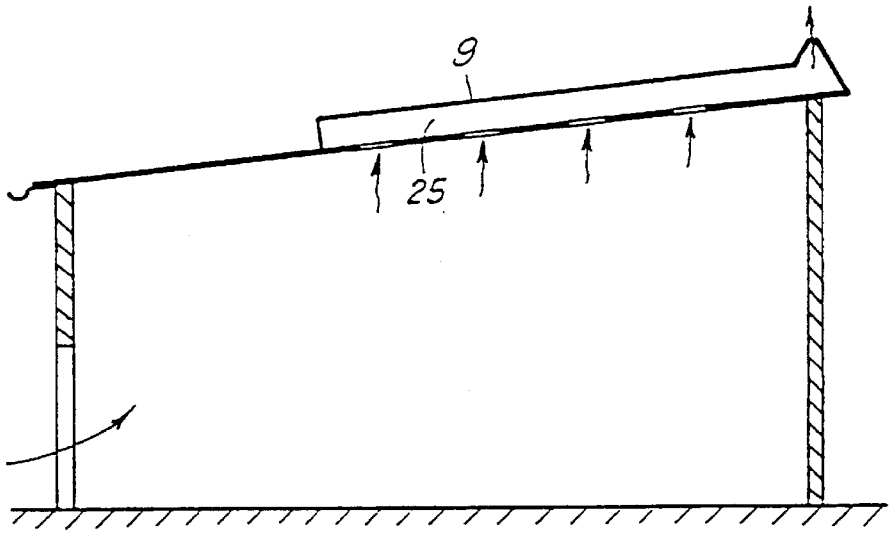

FIG. 12 shows the use of the invention in a building with a covering having a single pitch. The panel is again indicated by 9. It may (as also in FIGS. 10 and 11) form a portion of the covering. Conversely, the panel 9 may also have a length equal to the length of the whole pitch and may have an air chamber 25 which extends over only part of the length of the pitch. It is also possible to have an air chamber 25 which extends over the whole length of the pitch.

Figure 13:
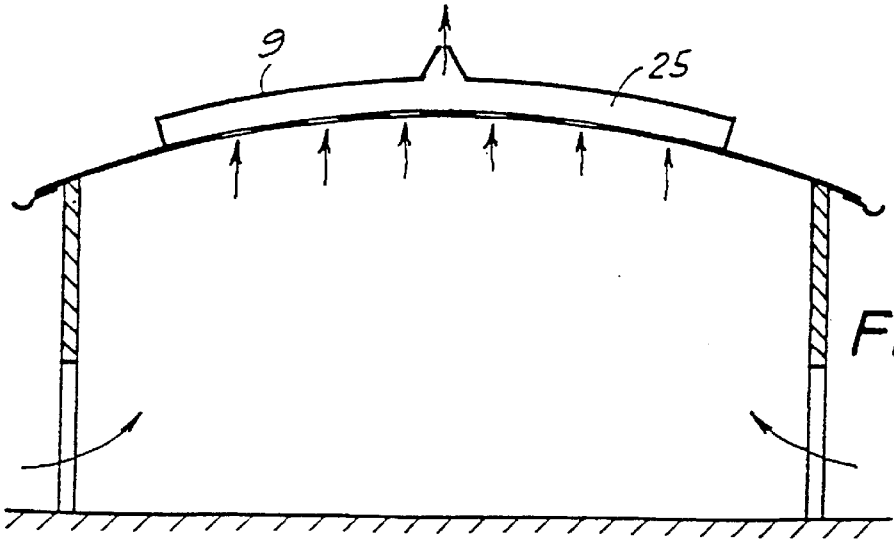

FIG. 13 shows a further type of covering in which the present invention may be applied. In this case, the covering is of the vault or arch type and the panel 9 with the air chamber occupies at least the central, highest area of the covering. The panel 9 has a curved shape to follow the shape of the vaulted covering.

It is to be understood that the drawing shows only an example provided solely as a practical demonstration of the invention, and that this invention may be varied in its forms and dispositions without departure from the guiding concept of the invention. The presence of any reference numbers in the attached claims has the purpose of facilitating the reading of the claims with reference to the description and to the drawing, and does not limit the scope of protection represented by the claims.

What is claimed is:

1. A covering system for a building, comprising at least one panel having an inner chamber, a plurality of suction apertures through which said inner chamber is adapted to communicate with a void inside said building, and a discharge aperture, wherein said at least one panel is mounted on an exterior surface of said building in an inclined position so that said at least one panel has a higher end and a lower end, and said discharge aperture is arranged in relation to said at least one panel to be in a vicinity of the higher end and thus be in a position higher than said plurality of suction apertures, and wherein a channel for collection of rainwater is disposed under said discharge aperture.

2. A covering system as claimed in claim 1, wherein said channel extends substantially parallel to said discharge aperture.

3. A covering system for a building, comprising at least one panel having an inner chamber, a plurality of suction apertures through which said inner chamber is adapted to communicate with a void inside said building, and a discharge aperture, wherein said at least one panel is mounted on an exterior surface of said building in an inclined position so that said at least one panel has a higher end and a lower end, and said discharge aperture is arranged in relation to said at least one panel to be in a vicinity of the higher end and thus be in a position higher than said plurality of suction apertures, and wherein said covering system further comprises a plurality of said at least one panel, a plurality of inclined glazed units, and a plurality of beams, wherein said plurality of said at least one panel, said glazed units and said beams form a "shed" type covering.

* * * * *